United States Patent [19]

Kumar

[11] Patent Number: 4,664,611

[45] Date of Patent: May 12, 1987

[54] PLASTER DISPENSING APPARATUS FOR WALLBOARD STRUCTURES

[75] Inventor: Sudhir Kumar, Westmont, Ill.

[73] Assignee: Drywall Taping Tools, Inc., East Hazelcrest, Ill.

[21] Appl. No.: 830,504

[22] Filed: Feb. 18, 1986

[51] Int. Cl.[4] ..... B29C 3/00

[52] U.S. Cl. ..... 425/87; 222/386

[58] Field of Search ..... 222/386; 425/87, 458

[56] References Cited

U.S. PATENT DOCUMENTS

| | | | |
|---|---|---|---|
| 796,246 | 8/1905 | Printz | 425/87 |
| 1,263,590 | 4/1918 | Morrow | 222/386 |
| 1,583,533 | 5/1926 | Deming | 222/386 |
| 1,613,239 | 1/1927 | Miller | 425/87 |
| 2,102,209 | 12/1937 | McDannold | 222/386 |
| 2,725,595 | 12/1955 | Sisk et al. | 425/87 |
| 2,889,699 | 6/1959 | Ames | 425/87 |
| 3,602,405 | 8/1971 | Ames | 222/386 |
| 4,132,517 | 1/1979 | Ames | 425/87 |

*Primary Examiner*—Charles Hart

*Attorney, Agent, or Firm*—Welsh & Katz, Ltd.

[57] ABSTRACT

Apparatus for dispensing plaster and the like in the corners of wallboard structures includes an enclosure having a pressure plate which is used to force plaster through an opening in the enclosure. A transitional wall having a somewhat conical or trapezoidal shape is secured to the enclosure around the opening. The smaller open end of the transitional wall forms a transitional orifice having an area which is less than the area of the opening in the enclosure.

A spout is secured to the transitional wall around the transitional orifice. The axis of the spout forms an acute angle with the fixed wall, so that the nozzle of the spout is tilted with respect to the enclosure.

The transitional wall forms a chamber which permits plaster and the like to be dispensed evenly, with reduced effort, resulting in a smoother surface when the plaster is dispensed. The angle of the spout further improves the even dispensing of the plaster, and permits easy access of the nozzle to corners near ceilings and the like.

11 Claims, 4 Drawing Figures

PLASTER DISPENSING APPARATUS FOR WALLBOARD STRUCTURES

This invention relates to dispensing apparatus for applying uncured plaster and the like to corners of wallboard structures, and more particularly, to apparatus which dispenses uncured plaster in a steady flow so that the dispensed plaster has a smooth surface.

BACKGROUND OF THE INVENTION

Wallboard has been used for many years for interior walls of buildings. It is generally manufactured in sheets about 4 feet by 8 feet in size which are nailed to studs or the like to create a wall or a ceiling. Spaces between the sheets, spaces at the corners of walls, and spaces between the ceiling and the walls are usually covered with specially designed tape, and the tape, portions of the wallboard sheets which are adjacent to the tape, and nail holes, if any, are covered or filled with uncured plaster or the like. When the plaster sets, it is sanded to create a smooth surface so that when the walls and ceiling are painted, the tape and nail holes will not be seen.

Professional contractors and others often apply plaster to corners with dispensing apparatus which is designed for that purpose, such as that shown in FIG. 7 of U.S. Pat. No. 2,889,699. That apparatus includes two opposing generally triangular side walls having two straight edges and an arcuate edge which joins the divergent ends of the straight edges. A rectangular wall is secured to the side walls along a straight edge, and an arcuate trailing wall is secured between the arcuate edges of the side walls. A wiping member is anchored near the converging ends of the straight edges and extends between the side walls to the trailing wall. The side walls, rectangular wall, arcuate wall and wiping member form an enclosure for containing uncured plaster. The wiping member may be pivoted towards and away from the rectangular wall to change the volume of the space inside of the enclosure.

In FIG. 7 of U.S. Pat. No. 2,889,699, a spout is located over a substantially round orifice in a portion of the rectangular wall which is away from the converging ends of the side walls. The area of the orifice appears to be about 20 percent of the area of the entire rectangular wall. The spout has a generally conical shape, with the broad end, or base, secured around the orifice. The outlet, or nozzle, is in the narrow end of the spout. When the wiping member is pulled away from the spout, the enclosure may be filled with plaster through a filler hole in the rectangular wall. The wiping member may then be pressed towards the rectangular wall under a predetermined amount of pressure, forcing the plaster through the orifice and spout at a desired rate.

In operation, the dispensing apparatus of FIG. 7 of U.S. Pat. No. 2,889,699 is used in conjunction with a corner head to apply plaster or the like in corners. Since the area of the orifice in the dispensing apparatus is considerably smaller than the area of the rectangular wall, and the transition from the rectangular wall to the spout is abrupt, the plaster does not flow steadily and efficiently within the enclosure and through the orifice and spout. As a result, eddy currents are developed which disturb the flow of the plaster, resulting in the creation of a "dead space" where the plaster hardly moves at all, as will be described in connection with FIG. 4 of this specification.

As a result of the eddy currents and dead space, the plaster comes out of the nozzle in ripples, instead of having a steady flow. Consequently, the dispensed plaster has a wavy, uneven surface, which is undesirable. Also, substantial pressure is required to force the plaster out of the spout, due to the configuration of the apparatus and the presence of the eddy currents and dead space. Applying such pressure is tiring, especially for professional contractors and others who use the apparatus for several hours at a time.

The resulting uneven surface of the plaster, and the substantial pressure required to apply the plaster, also increases the level of skill and attention required to accurately and properly dispense the plaster. At heights over a few feet, a handle is usually secured to the wiping member, so that a ladder or scaffolding is not needed to reach the heights. The use of such a handle requires an even higher level of skill and attention, and proper application of the plaster is made even more difficult because of the substantial pressure which must be applied. Thus, there is a need for apparatus for dispensing plaster and the like in corners which releases the plaster in a steady flow so that the plaster forms a smooth surface, and requires reduced pressure during operation.

The spouts on known plaster dispensers for corners extend generally perpendicular to the rectangular wall, so that part of the base of the spout and part of the rectangular wall extend above the nozzle when the nozzle is directed into a corner. The extension above the nozzle makes it difficult for the user to accurately and properly dispene plaster in corners near the ceiling. Thus, there is a need for apparatus for dispensing plaster in corners which can easily reach corners near the ceiling, and can accurately and properly dispense plaster in such corners.

Accordingly, one object of this invention is to provide new and improved plaster dispensing apparatus for wallboard structures.

Another object is to provide new and improved apparatus for dispensing plaster in corners which releases plaster in a steady flow so that the dispensed plaster has a smooth surface.

Yet another object is to provide new and improved apparatus for dispensing plaster in corners which offers a reduced degree of resistance to the flow of plaster out of the dispensing apparatus.

Still another object is to provide new and improved plaster dispensing apparatus which can easily and accurately dispense plaster in corners near the ceiling.

SUMMARY OF THE INVENTION

In keeping with one aspect of this invention, apparatus for dispensing plaster and the like in the corners of wallboard structures includes an enclosure having two side walls, a front wall, an arcuate wall and a pressure plate. The side walls have the general shape of a segment of a circle, with two side edges which converge towards each other, and an arcuate edge which extends between the divergent ends of the side edges. The side walls are held in spaced relation to each other by the front wall, which is generally rectangular in shape and is secured to one of the side edges of each side wall, and the arucate wall, which extends between the arcuate edges of the side walls. The pressure plate is secured for rotational movement within the walls. One end of the pressure plate pivots near an end of the front wall adjacent to the converging ends of the side edges, while the other end of the pressure plate slides across the arcuate wall when the pressure plate is rotated.

The pressure plate may be rotated over a predetermined angular range to vary the volume of space within the enclosure. When the pressure plate is away from the front wall, the volume of the enclosure is at a maximum, and as the pressure plate is pushed towards the front wall, the volume decreases.

The front wall has an opening in a portion of the front wall which is away from the pivoted end of the pressure plate. The opening may be round, but is preferably square or rectangular, and may encompass the entire end portion of the front wall. The area of the opening is preferably about 45 percent of the area of the front wall, as measured from the pivotal end of the pressure plate to the arcuate wall.

A transitional wall having a somewhat conical or trapezoidal shape is secured to the front wall around the opening, and extends outwardly from the enclosure. The transitional wall may be fabricated as a separate piece, or as an integral part of the front wall. The base, or larger open end of the transitional wall is secured to the front wall, and the smaller open end of the transitional wall forms a transitional orifice having an area which is less than the area of the opening in the front wall.

A spout is secured to the transitional wall around the transitional orifice. The spout may be a separate piece, or it may be integral with the transitional wall. The spout has a generally tube shaped shell having a narrowing diameter which is formed around an axis. The spout extends away from the front wall, and ends in a nozzle having a narrow opening. The axis of the spout forms an acute angle with the fixed wall, so that the nozzle is tilted away from the pivotal end of the pressure plate.

The transitional wall forms a step chamber between the enclosure and the spout. Preferably, the volume of the step chamber is comparable to the volume of the spout, and the area of the base of the transitional wall is about twice the area of the open end of the transitional wall.

This apparatus provides several improvements over known devices. The front wall, transitional wall and spout are constructed so that plaster is dispensed from the apparatus in a smooth flow, without creating a dead space within the spout, and without rippling as the plaster is dispensed. As a result, the dispensed plaster has a smooth surface. In addition, the apparatus produces a reduced degree of resistance to the flow of plaster out of the apparatus, so that less pressure is required to dispense the plaster. The angle of the spout further improves the flow of the plaster and further reduces the pressure required to operate the apparatus. In addition, the angle of the spout results in easier, more accurate dispensing of plaster in corners which are not easily accessible.

BRIEF DESCRIPTION OF THE DRAWINGS

The above-mentioned and other features of this invention and the manner of obtaining them will become more apparent, and will be best understood by reference to the following description, taken in conjunction with the accompanying drawings in which.

DETAILED DESCRIPTION

Figure 1:
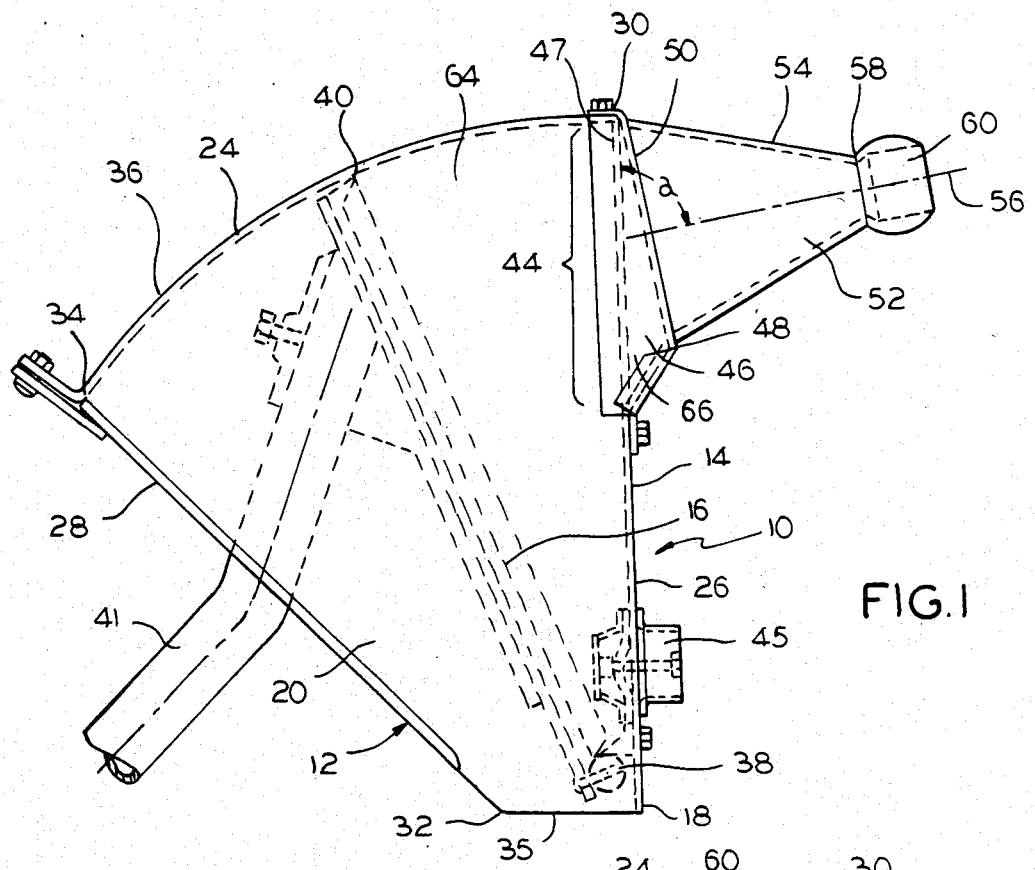
FIG. 1 is a side elevation view of plaster dispensing apparatus made in accordance with the principles of this invention.
Figure 2:
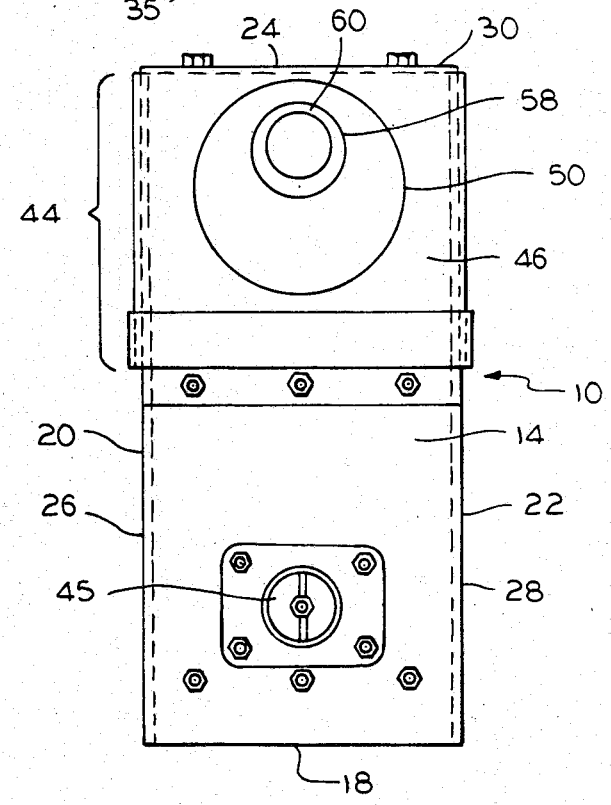
FIG. 2 is a front elevation view of the apparatus of FIG. 1.

As seen in FIGS. 1 and 2, dispensing apparatus 10 includes an enclosure 12 having several walls, including a generally rectangular front wall 14, a pressure plate 16 which pivots adjacent to an edge 18 of the front wall 14, two side walls 20, 22, and a trailing wall 24.

The side walls 20, 22 have substantially identical shapes which resemble a segment of a circle. The side walls 20, 22 have two side edges 26, 28. The side edge 26 extends from the edge 18 of the front wall 14 to an edge 30 of the front wall 14, and the side edge 28 extends from an end 32 to an end 34. A bottom wall 35 joins the side walls 20, 22 between the ends 32 and the edge 18.

The side edges 26, 28 converge towards each other at the edge 18 of the front wall 14 and the ends 32 of the edges 28, and diverge away from each other at the edge 30 of the wall 14 and the ends 34 of the edges 28. The side edges 26, 28 have an arcuate edge 36 which extends from the edge 30 to the ends 34.

The pressure plate 16 is generally rectangular, and extends between the side walls 20, 22 from a pivot or hinge 38 to an edge 40. The pivot or hinge 38 preferably has a seal made of rubber or the like, to prevent plaster from escaping near the pivot 38.

The edge 40 abuts the arcuate wall 24 so that it maintains substantially sealed contact with the wall 24 as the plate 16 rotates about the pivot 38. A handle 41 may be secured to the pressure plate 16 by any suitable means, and may be any suitable length. The handle 41 preferably may be easily removed and replaced with handles of varying lengths, so that a short handle may be used at relatively low heights and a longer handle may be used at relatively high heights.

The arcuate wall 24 extends between the arcuate edges 36 of the side walls 20, 22, and secures the side walls 20, 22 in fixed, substantially parallel relation to each other. The arcuate wall 24 is formed so that when the pressure plate 16 is turned on its hinge or other pivot 38, the edge 40 of the pressure plate 16 maintains contact with the wall 24.

The front wall 14 also holds the side walls 20, 22 in fixed relation to each other. The front wall 14 includes an enclosure opening 44 and an inlet 45. The enclosure opening 44 is in a portion of the front wall 14 which is adjacent to the edge 30 of the front wall 14, and the inlet 45 is in a portion of the front wall 14 which is adjacent to the edge 18.

The opening 44 may be round, but is preferably square or rectangular, and may encompass the entire end portion of the front wall 14, as seen in FIG. 2. In one preferred embodiment, the area of the opening 44 is about 45 percent of the area of the front wall 14, measuring the wall 14 from about the pivot 38 to the edge 30.

A somewhat conical or trapezoidal transitional wall 46 is secured to the front wall 14 around the enclosure opening 44, outside of the enclosure 12. The wall 46 may be separately fabricated and secured to the front wall 14, or it may be formed integrally with the wall 14. The transitional wall 46 has a base 47 which is secured to the front wall 1, and a small end 48 which forms a transitional orifice 50. The transitional orifice 50 has an area which is less than the area of the enclosure opening 44.

A spout 52 (FIG. 1 is secured to the transitional wall 46 around the transitional orifice 50. The spout 52 may be a separate piece, or it may be formed integrally with the transitional wall 46. The spout 52 has a generally tube shaped shell 54 having a narrowing diameter. The shell 54 is formed around an imaginary axis 56. The spout 52 extends away from the front wall 14, and ends in a nozzle 60 having a narrow opening 58.

The axis 56 forms an angle a with the plane formed by the fixed wall 14 so that the spout 52 and nozzle 60 are tilted away from the pivot 38. The angle a is an acute angle when measured between the axis 56 and the front wall 14 towards the edge 30, and is about 15 degrees as shown in FIG. 1. The angle a may vary somewhat depending upon the shape and size of various parts of the apparatus 10.

Uncured plaster or the like may be injected into the enclosure 12 through the inlet 45. The plaster is contained within a holding chamber 64 formed by the front wall 14, portions of the side walls 20, 22, the arcuate wall 24, and the pressure plate 16. The volume of the chamber 64 is a maximum when the pressure plate 16 is turned away from the fixed wall 14, and a minimum when the pressure plate 16 is pressed adjacent to the front wall 14.

The transitional wall 46 forms a step chamber 66 between the enclosure 12 and the spout 52. As measured from the enclosure oopening 44 to the transitional orifice 50, the volume of the step chamber 66 is preferably comparable to the volume of the spout 52, as measured from the orifice 50 to about the opening 58, and the area of the enclosure opening 44 is about twice the area of the orifice 50 of the transitional wall 46.

Figure 3:
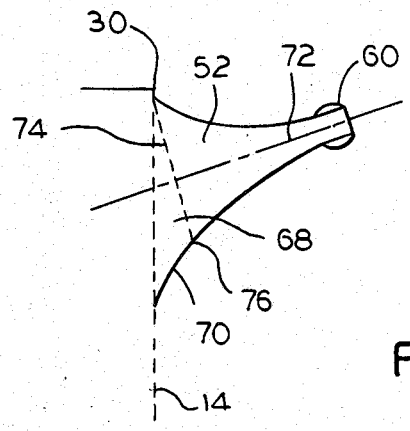
FIG. 3 is an alternate embodiment of the step chamber and spout of FIG. 1.

An alternate embodiment of the step chamber and nozzle is shown in FIG. 3. In FIG. 3, a step chamber 68 includes a curved portion 70 opposite the edge 30 which furter facilitates the flow of plaster through the nozzle 60. The step chamber 68 may be defined generally by drawing an axis 72 through the center of the spout 52 and drawing a perpendicular line 74 from the edge 30 of the front wall 14 to an intersection 76 with the curved portion 70. The step chamber 68 is to the left of the line 74 in FIG. 3, and the spout 72 begins to the right of the line 74. Using the line 74 as a reference, the step chamber 68 and the spout 52 may be designed so that the volume of the step chamber 68 is comparable to the volume of the spout 52, and the area of the enclosure opening 44 is about twice the area of the orifice 50 of the transitional wall 46.

Figure 4:
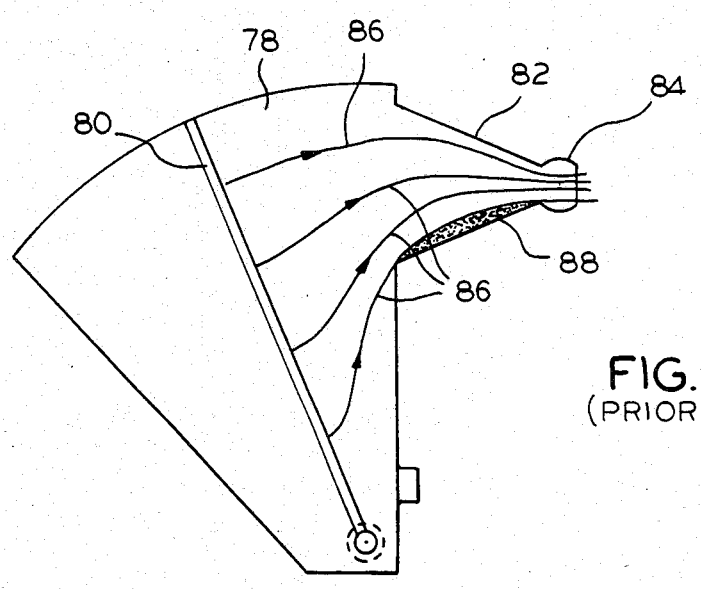
FIG. 4 (PRIOR ART)
FIG. 4 is a side elevation view of prior art plaster dispensing apparatus.

The many advantages of this invention will be best understood with reference to FIG. 4, which shows known dispensing apparatus. The apparatus of FIG. 4 includes a holding chamber 78, and a wiping member 80 which forces plaster in the chamber 78 out of the apparatus through a spout 82 and a nozzle 84. When the plaster is dispensed, it flows generally in a manner shown by flow lines 86. Because of the manner in which the apparatus of FIG. 4 is designed, a dead space 88 is created in the spout 82 as the plaster is dispensed. As a result, the plaster does not flow smoothly from the nozzle 84, but tends to be dispensed in spurts, in a rippling manner. This is undesirable because the resulting surface of the dispensed plaster is not smooth.

One advantage of the present invention is that the dead space 88 of FIG. 4 is eliminated, or at least reduced enough so that the plaster is dispensed evenly, without rippling, and the resulting surface of the dispensed plaster is smooth. This advantage is achieved by providing the transitional wall 46 and step chamber 66 in the embodiment of FIG. 1, or the step chamber 68 in the embodiment of FIG. 3, in combination with other parts of the apparatus, in the manner taught herein. The advantage is further achieved by tilting the spout 72 in the manner described, and by making the opening 44 square or rectangular instead of circular, so that its area is increased.

Another advantage of this invention is that less pressure is required to dispense plaster. In the known device of FIG. 4, the dead space 88 and the manner in which the spout 82 and the walls which form the chamber 78 interact increases the pressure which must be placed on the wiping member 80 to dispense plaster. In the present invention, the pressure required to dispense plaster is reduced by providing the wall 46 and step chamber 66 of FIG. 1, or the step chamber 68 of FIG. 3, and is further reduced by tilting the spout 72 in the manner described. The pressure required is still further reduced if the area of the opening 44 is increased by making it square or rectangular.

A pressure reduction of between about 20 percent and about 25 percent may be achieved by applying the principles of this invention. As a result of the reduced pressure required to dispense the uncured plaster, the apparatus is easier to operate, especially when it is used over a period of several hours, and the level of skill and attention required is reduced. If an extended handle is secured to the pressure plate, the reduced pressure provides an even greater advantage.

Tilting the spout 72 in the manner described provides yet another advantage. The spout 82 in the known device of FIG. 4 extends substantially perpendicular to the wall to which it is secured. As a result, it is difficult to dispense plaster in corners near the ceiling, for example, which are not easily accessible. In the present invention, the angle of the spout 72 permits easy access to such corners, and accurate dispensing of plaster in such situations.

While the principles of the invention have been described above in connection with specific apparatus and applications, it is to be understood that this description is made only by way of example and not as a limitation on the scope of the invention.

What is claimed is:

1. Apparatus for dispensing uncured plaster and the like into corners of wallboard structures and the like, said apparatus comprising an enclosure, said enclosure having a generally rectangular front wall, a pressure plate which pivots adjacent to a first edge of said front wall, and two opposing side walls secured to said front wall and spaced in substantially parallel relation to each other, said side walls generally having the shape of a segment of a circle, said side walls each having two side edges which converge towards each other at one end and diverge away from each other at the other end, and an arcuate edge extending between the diverging ends of said side edges, said enclosure further having an arcuate wall extending between said arcuate edges of said side walls to further secure said side walls in fixed, substantially parallel relation to each other, said arcuate wall also being secured to a second edge of said front wall, said second edge being opposite to said first edge and substantially perpendicular to said side walls;

said pressure plate extending between said side walls and from a pivot point adjacent to said front wall to said arcuate wall, said pressure plate being rotatable about said pivot point between said side edges of said side walls;

said front wall having an enclosure opening in a portion of said front wall which is adjacent to said arcuate edges of said side walls;

a transitional wall secured to said front wall around said enclosure opening and outside of said enclosure, said transitional wall having an end away from aid fixed wall which forms a transitional orifice, said transitional orifice having an area which is less than the area of said enclosure opening; and a spout secured to said transitional wall around said transitional orifice, said spout having an axis and a generally tube shaped shell having a narrowing diameter and ending in a narrow opening to which a nozzle is secured, said axis forming an angle with said front wall so that said spout and said nozzle are tilted away from said pivot point.

2. The apparatus of claim 1 wherein the area of said enclosure opening is at least about 45 percent of the area of said front wall, said front wall area being measured from about said pivot point to said second edge.

3. The apparatus of claim 1 wherein said transitional orifice area is about one-half of said enclosure opening area.

4. The apparatus of claim 1 wherein said transitional wall forms a step chamber between said enclosure opening and said transitional orifice, the volume of said step chamber being comparable to the volume of said spout, the volume of said spout being measured from said transitional orifice to about said narrow opening.

5. The apparatus of claim 1 wherein said transitional wall is integral with said front wall.

6. The apparatus of claim 1 wherein said spout is integral with said transitional wall.

7. The apparatus of claim 1 wherein said enclosure opening is at least partly circular.

8. The apparatus of claim 1 wherein said enclosure opening is rectangular.

9. The apparatus of claim 1 comprising an inlet in said front wall for placing uncured plaster in said enclosure.

10. The apparatus of claim 1 comprising a handle secured to said pressure plate for selectively rotating said pressure plate.

11. The apparatus of claim 1 wherein said transitional wall forms a step chamber between said enclosure opening and said transitional orifice, said transitional wall having a curved portion, and said step chamber being defined generally by drawing an axis through the center of said spout and drawing a line perpendicular to said axis from said second edge of said front wall, through said axis, to an intersection with said curved portion, said step chamber extending from said enclosure opening to said perpendicular line, said step chamber having a volume which is comparable to volume of said spout, as measured from said perpendicular line to about said narrow opening.

* * * * *